US005992778A

United States Patent [19]

Rumsey et al.

[11] Patent Number: 5,992,778

[45] Date of Patent: Nov. 30, 1999

[54] CUTTING MEMBER FOR A CLEANING APPARATUS USED TO DISLODGE ADHERENT BULK MATERIAL IN A STORAGE CONTAINER

[75] Inventors: Bronson Rumsey, Peoria, Ill.; Terry Thew, Bilambil Heights, Australia

[73] Assignee: Martin Engineering Company, Neponset, Ill.

[21] Appl. No.: 09/126,874

[22] Filed: Jul. 31, 1998

[51] Int. Cl.[6] ..... B02C 18/16

[52] U.S. Cl. ..... 241/282.1; 241/292.1

[58] Field of Search ..... 241/277, 292.1, 241/292, 291, 282.1, 282.2; 30/347, 276; 414/324

[56] References Cited

U.S. PATENT DOCUMENTS

| | | | |
|---|---|---|---|
| 2,149,193 | 2/1939 | Stock | 241/292.1 |
| 2,636,530 | 4/1953 | Williams | 241/292.1 |
| 4,360,276 | 11/1982 | Jack . | |
| 4,451,004 | 5/1984 | Ostergren et al. . | |
| 4,509,701 | 4/1985 | Jack et al. . | |
| 4,571,138 | 2/1986 | Farajun . | |
| 4,599,029 | 7/1986 | Zyduck . | |
| 4,942,982 | 7/1990 | Hartwigsen et al. . | |
| 5,096,262 | 3/1992 | Foullois | 241/277 |
| 5,464,164 | 11/1995 | Doppstadt . | |

*Primary Examiner*—Mark Rosenbaum

*Attorney, Agent, or Firm*—Lee, Mann, Smith, McWilliams, Sweeney & Ohlson

[57] ABSTRACT

A cutting member adapted to be coupled to a rotatable flail of a cleaning apparatus for dislodging adherent bulk material in a storage container. The cutting member includes a hub having a cylindrical bore formed about a central longitudinal axis. A plurality of first fingers are attached to the hub and extend generally radially outwardly from the hub in a direction perpendicular to the longitudinal axis. The plurality of first fingers are located in a generally circular manner about the hub. A plurality of second fingers are attached to the hub in a generally circular manner about the hub and extend generally radially outwardly from the hub in a direction generally perpendicular to the hub. Each second finger is located in a rotated position about the longitudinal axis of the hub with respect to a respective first finger. Each first finger and each second finger is respectively formed as a truncated rectangular pyramid having a plurality of side cutting surfaces, wherein each side cutting surface includes a pair of side cutting edges and a tip cutting edge.

26 Claims, 1 Drawing Sheet

CUTTING MEMBER FOR A CLEANING APPARATUS USED TO DISLODGE ADHERENT BULK MATERIAL IN A STORAGE CONTAINER

BACKGROUND OF THE INVENTION

The present invention is directed to a cutting member for use in connection with a rotatable flail of a cleaning apparatus for dislodging adherent bulk material in a storage container, and in particular to a cutting member having a plurality of outwardly projecting fingers with each finger formed as a truncated rectangular pyramid including a plurality of cutting surfaces and a plurality of cutting edges.

The storage of granular and similar bulk material, such as grain products and coal, in storage containers such as bins, hoppers, and silos creates many problems, particularly in the discharge of such bulk material as the bulk material has a tendency to become lodged in place and refuse to flow due to bridging and other problems. When bulk material within a storage container refuses to flow or resists flow, the obstructing adherent bulk material decreases the capacity of the storage container and restricts the flow of bulk material through the storage container. A cleaning apparatus, such as disclosed in U.S. Pat. No. 4,509,701, having a pair of rotatable flails has been used to break and cut loose adherent bulk material such that the adherent material will freely flow through the storage container. Each flail of the cleaning apparatus as previously used has been provided with a cutting member comprising a generally cylindrical disc made from ultra-high molecular weight polyethylene. The disc-shaped prior art cutting member is limited to providing cutting of the adherent bulk material in one direction only.

SUMMARY OF THE INVENTION

A cutting member adapted to be coupled to a rotatable flail of a cleaning apparatus utilized to break up and dislodge obstructing adherent bulk material in a storage container. The preferred embodiment of the cutting member includes a hub having a first end and a second end and a central longitudinal axis extending from the first end to the second end. The hub is adapted to be coupled to the flail of the cleaning apparatus. A plurality of first fingers are attached to the hub. Each first finger extends generally radially outwardly from the hub in a direction generally perpendicular to the longitudinal axis of the hub. The plurality of first fingers are located in a generally circular manner about the longitudinal axis of the hub and are generally uniformly spaced with respect to one another about the hub. Each first finger includes a base located at the hub, a tip spaced generally radially outwardly from the hub, and a central radial axis extending from the base to the tip.

The cutting member also includes a plurality of second fingers attached to the hub, with each second finger extending generally radially outwardly from the hub in a direction generally perpendicular to the longitudinal axis of the hub. The second fingers are constructed generally identical to the first fingers. The plurality of second fingers are located in a generally circular manner about the longitudinal axis of the hub and are generally uniformly spaced with respect to one another about the longitudinal axis of the hub. The plurality of second fingers are located on the hub longitudinally adjacent to the plurality of first fingers. Each second finger is located in a rotated position about the longitudinal axis of the hub with respect to a respective first finger. Each first finger and each second finger is formed generally as a truncated rectangular pyramid having a plurality of side cutting surfaces with each side cutting surface including a pair of spaced apart and opposing side cutting edges and a tip cutting edge. The cutting member is preferably formed entirely of an elastomeric material such as polyurethane.

BRIEF DESCRIPTION OF THE DRAWING FIGURES

DETAILED DESCRIPTION OF THE PREFERRED EMBODIMENT

Figure 1:
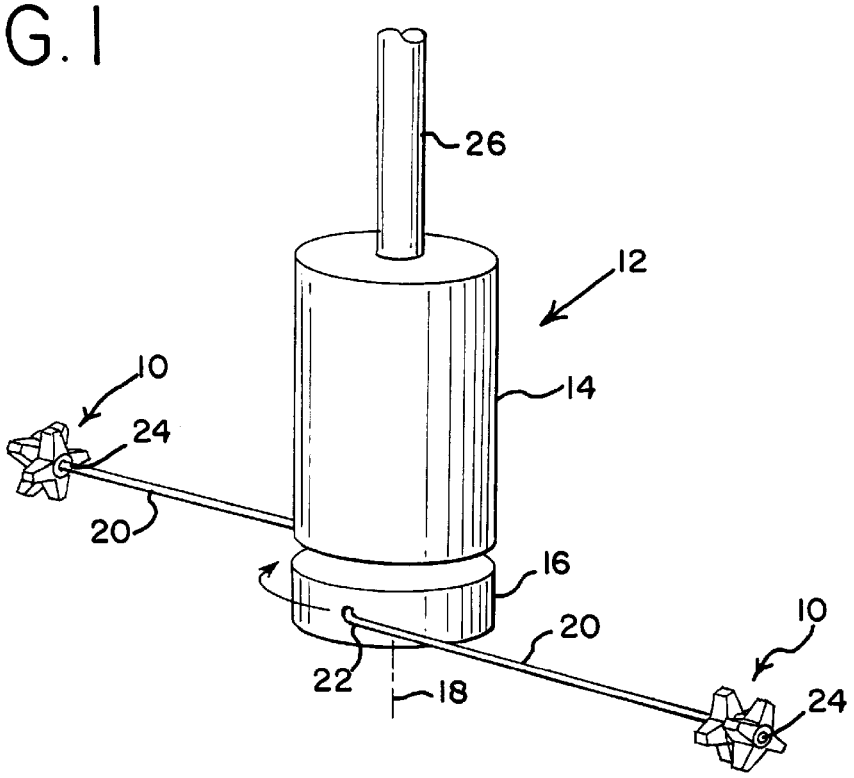
FIG. 1 is a perspective view of a cleaning apparatus for breaking up and dislodging adherent bulk material shown with the cutting member of the present invention coupled to each flail of the cleaning apparatus.

As shown in FIG. 1, the cutting member 10 of the present invention is adapted to be used in connection with a cleaning apparatus 12 that is used to break up and dislodge adherent bulk material, such as grain products, coal or the like, that refuses to flow or resists flow within a storage container such as a silo, bin, hopper or the like. The cleaning apparatus 12 includes a head 14 and a rotor 16. The rotor 16 is rotatably attached to the bottom end of the head 14 and is adapted to rotate with respect to the head 14 about a vertical axis 18 that extends centrally through the head 14 and rotor 16. A pair of flexible flails 20 are respectively attached to the rotor 16 on diametrically opposite sides of the rotor 16. Each flail 20 includes a first end 22 that is attached to the rotor 16 and a second end 24 that is adapted to be associated with and coupled to the cutting member 10. An elongate flexible tether 26 is attached to the top of the head 14. The tether 26 supplies pneumatic or electric power to the cleaning apparatus 12 to provide rotation of the rotor 16 and the flails 20 about the axis 18. The tether 26 also provides selective upward and downward vertical movement of the cleaning apparatus 12, and also selective horizontal movement of the cleaning apparatus 12, within the storage container. As shown in FIG. 1, a cutting member 10 is associated with and coupled to the second end 24 of each flail 20.

Figure 2:
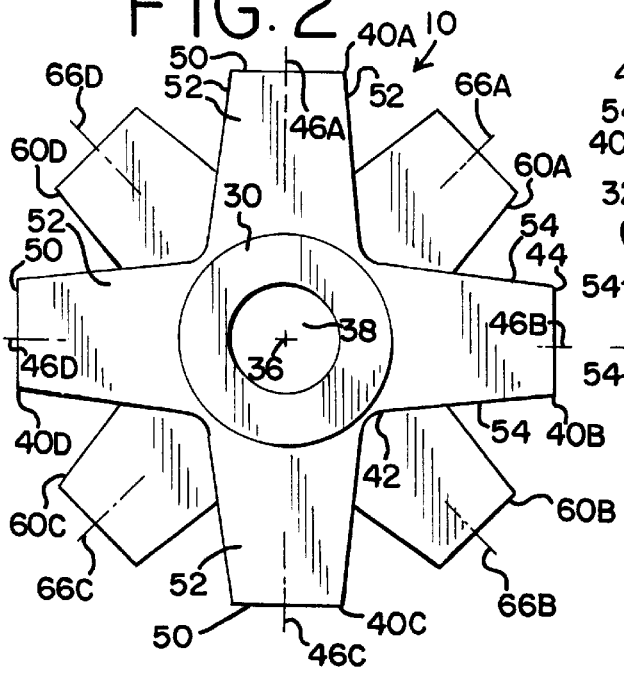
FIG. 2 is a front elevational view of the cutting member of the present invention.
Figure 3:
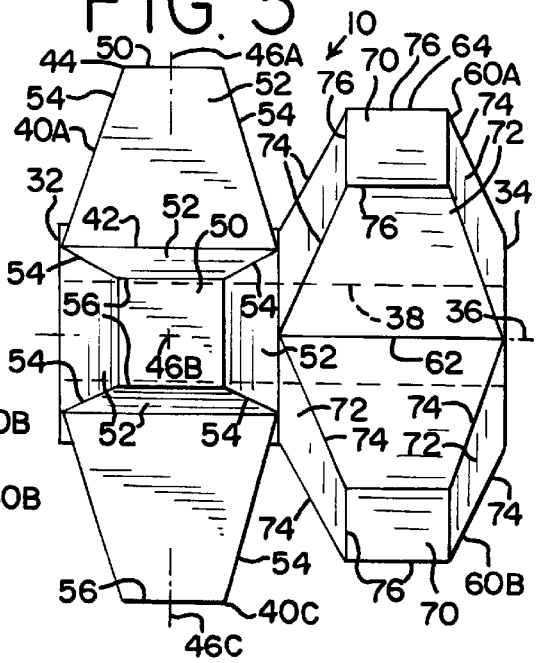
FIG. 3 is a side elevational view of the cutting member.

As best shown in FIGS. 2 and 3, the cutting member 10 includes a generally cylindrical hub 30 having a first end 32 and a second end 34. The hub 30 includes a central longitudinal axis 36 and a generally cylindrical bore 38 that extends from the first end 32 to the second end 34 of the hub 30 generally concentrically about the longitudinal axis 36. The bore 38 is adapted to receive and retain the second end 24 of the flail 20.

The cutting member 10 includes four first fingers 40A–D attached to the hub 30. The cutting member 10 may include fewer first fingers or additional first fingers if desired. Each first finger 40A–D is formed generally as a truncated rectangular pyramid having a rectangular base 42 located at the hub 30 and a tip 44 spaced generally radially outwardly from the hub 30. Each first finger 40A–D also includes a respective central radial axis 46A–D that extends longitudinally within each first finger 40A–D from the base 42 to the tip 44. Each radial axis 46A–D intersects the longitudinal axis 36 of the hub 30 and is disposed generally at a right angle thereto. The first fingers 40A–D extend generally radially outwardly from the hub 30 in a direction generally perpendicular to the longitudinal axis 36 of the hub 30. The first fingers 40A–D are located in a generally circular manner about the longitudinal axis 36 of the hub 30 and are generally uniformly spaced with respect to one another about the hub 30. As shown in FIG. 2, each first finger 40A–D is disposed at a generally right angle to each adjacent first finger 40A–D. The radial axes 46A–D are generally located in a common plane that is perpendicular to the longitudinal axis 36 of the hub 30.

The base 42 of each respective first finger 40A–D extends between and is located closely adjacent to the base 42 of each adjacent first finger 40A–D. Each first finger 40A–D includes a generally planar apex surface 50 that is generally rectangular or square and that is generally perpendicular to the radial axis 46A–D of the first finger. As best shown in FIG. 3, the base 42 of each first finger 40A–D has a greater width and a greater height than the width and height of the apex surface 50 at the tip 44. The apex surface 50 is centrally located above the base 42. Each first finger 40A–D also includes four generally planar side cutting surfaces 52. Each side cutting surface 52 extends from the base 42 to the tip 44 of its respective first finger 40A–D. Each side cutting surface 52 includes two spaced apart and opposing side cutting edges 54 that extend from the base 42 to the apex surface 50. The opposing side cutting edges 54 of a side cutting surface 52 converge toward one another as they extend from the base 42 to the tip 44 of each respective first finger 40A–D. Adjacent side cutting surfaces 52 intersect at a common side cutting edge 54 such that each first finger 40A–D includes four side cutting edges 54. Each side cutting surface 52 also includes a tip cutting edge 56 formed at the intersection of the side cutting surface 52 and the apex surface 50 and that extends between opposing side cutting edges 54.

The preferred embodiment of the cutting member 10 also includes four second fingers 60A–D. The cutting member 10 may include additional or fewer second fingers, but preferably includes the same number of second fingers as first fingers. For some operations the second fingers may be eliminated entirely. Each second finger 60A–D is formed substantially as a truncated rectangular pyramid. The second fingers 60A–D are constructed generally identical to the first fingers 40A–D. Each second finger 60A–D includes a generally rectangular base 62 located at the hub 30 and a tip 64 spaced generally radially outwardly from the hub 30. Each second finger 60A–D includes a respective radial axis 66A–D. Each radial axis 66A–D extends from the base 62 to the tip 64 of a respective second finger 60A–D. Each radial axis 66A–D intersects the longitudinal axis 36 of the hub 30 and is generally perpendicular thereto. The radial axes 66A–D are generally located in a common plane that is spaced apart and generally parallel to the plane in which the radial axes 46A–D of the first fingers 40A–D are located. The second fingers 60A–D are attached to the hub 30 and extend generally radially outwardly from the hub 30 in a direction generally perpendicular to the longitudinal axis 36 of the hub 30. The second fingers 60A–D are located in a generally circular manner about the longitudinal axis 36 of the hub 30 and are generally uniformly spaced with respect to one another about the longitudinal axis 36 and hub 30. As shown in FIG. 2, each second finger 60A–D is generally located at a right angle to each adjacent second finger.

Each second finger 60A–D includes a generally planar apex surface 70 that is generally rectangular or square and that is generally perpendicular to a respective radial axis 66A–D. As best shown in FIG. 3, the base 62 of each second finger 60A–D has a greater width and a greater height than the width and height of the apex surface 70 at the tip 64. The apex surface 70 is centrally located above the base 62. Each second finger 60A–D also includes four generally planar side cutting surfaces 72. Each side cutting surface 72 extends from the base 62 to the tip 64 of its respective second finger 60A–D. Each side cutting surface 72 includes two spaced apart and opposing side cutting edges 74 that extend from the base 62 to the apex surface 70. The opposing side cutting edges 74 of a side cutting surface 72 converge toward one another as they extend from the base 62 to the tip 64 of each respective second finger 60A–D. Adjacent side cutting surfaces 72 intersect at a common side cutting edge 74 such that each second finger 60A–D includes four side cutting edges 74. Each side cutting surface 72 also includes a tip cutting edge 76 formed at the intersection of the side cutting surface 72 and the apex surface 70 and that extends between opposing side cutting edges 74.

As best shown in FIG. 2, each second finger 60A–D is located in a rotated position about the longitudinal axis 36 of the hub 30 with respect to a respective first finger 40A–D. Each adjacent pair of first fingers 40A–D are disposed at an angle relative to one another about the longitudinal axis 36 of the hub 30. Each second finger 60A–D is located in a rotated position about the longitudinal axis 36 with respect to a respective pair of adjacent first fingers 40A–D such that the second finger substantially bisects the angle between the adjacent pair of first fingers. For example, as shown in FIG. 2, the first finger 40A and the first finger 40B are located at approximately a ninety degree angle with respect to one another about the longitudinal axis 36. The second finger 60A is located in a rotated position about the longitudinal axis 36 with respect to the first fingers 40A and 40B such that the second finger 60A is disposed between the first fingers 40A and 40B at an angle of approximately forty-five degrees with respect to the first finger 40A and also to the first finger 40B. Each of the first fingers 40A–D, each of the second fingers 60A–D, and preferably the hub 30, are all formed entirely from a non-sparking material such as an elastomeric material. A preferred elastomeric material is polyurethane.

In operation, a cutting member 10 is coupled to a flail 20 by inserting the second end 24 of the flail 20 through the bore 38 in the hub 30. A fastener is attached to the second end 24 of the flail 20 to retain the cutting member 10 on the flail 20. A second cutting member 10 is similarly coupled to the second flail 20 of the cleaning apparatus 12. The rotor 16 of the cleaning apparatus 12 rotates the flails 20 and cutting members 10 about the axis 18. By virtue of centrifugal force the cutting members 10 are urged to the second end 24 of the flail 20. The cleaning apparatus 12 is lowered into the chamber of a storage container. As the cutting members 10 are rotated about the axis 18 they are flung into engagement with obstructing bulk material contained in a storage container that refuses to flow. The multiple cutting surfaces 52 and 72, and the multiple cutting edges 54, 56, 74, and 76, of the first and second fingers 40A–D and 60A–D of the cutting member 10 cut the obstructing bulk material in multiple directions thereby loosening and freeing the obstructing bulk material to flow through the storage container. The hub 30 and cutting member 10 are free to rotate about the axis 36 with respect to the flail 20 presenting different striking and cutting surfaces. Each first finger 40A–D and each second finger 60A–D respectively includes four side cutting surfaces 52 or 72, four side cutting edges 54 or 74, and four tip cutting edges 56 or 76 which provide improved efficiency in cutting and dislodging obstructing bulk material from within a storage container.

Various features of the invention have been particularly shown and described in connection with the illustrated embodiment of the invention, however, it must be understood that these particular arrangements merely illustrate, and that the invention is to be given its fullest interpretation within the terms of the appended claims.

What is claimed is:

1. A cutting member adapted to be associated with a rotatable flail of a cleaning apparatus for dislodging adherent bulk material in a container, said cutting member including:

a hub having a first end and a second end and a central longitudinal axis extending from said first end to said second end, said hub adapted to be associated with the flail of the cleaning apparatus;

a plurality of first fingers extending generally radially outwardly from said hub, said plurality of first fingers being located in a generally circular manner about said longitudinal axis of said hub and spaced with respect to one another about said hub, each said first finger being generally pyramidal-shaped and having a base located toward said hub, a tip spaced generally radially outwardly from said hub, a central radial axis extending from said base to said tip, and a plurality of side cutting surfaces extending from said base to said tip, each said side cutting surface including opposing side cutting edges;

whereby said cutting member is adapted to be urged by the flail of the cleaning apparatus into engagement with adherent bulk material in the container such that said side cutting edges and said side cutting surfaces of said first fingers dislodge the adherent bulk material and thereby free the bulk material to flow through the container.

2. The cutting member of claim 1 wherein each said side cutting surface of each said first finger is generally trapezoidal-shaped, and said side cutting edges of each said side cutting surface converge toward one another as said side cutting edges extend from said base to said tip of said first finger.

3. The cutting member of claim 1 wherein each said first finger is generally formed as a truncated pyramid having an apex surface at said tip of said first finger.

4. The cutting member of claim 3 wherein said apex surface of each said first finger is generally planar and generally perpendicular to said central radial axis of said first finger.

5. The cutting member of claim 1 wherein said central radial axes of said first fingers are generally located in a common plane that is generally perpendicular to said longitudinal axis of said hub.

6. The cutting member of claim 1 including four first fingers, each said first finger being disposed generally at a right angle relative to each adjacent first finger.

7. The cutting member of claim 1 wherein said base of each said first finger extends between and is located closely adjacent to said bases of adjacent first fingers.

8. The cutting member of claim 1 wherein said hub includes a central bore extending from said first end to said second end of said hub generally concentrically about said longitudinal axis of said hub.

9. The cutting member of claim 1 wherein said hub and said first fingers are formed from an elastomeric material.

10. The cutting member of claim 9 wherein said elastomeric material comprises polyurethane.

11. The cutting member of claim 1 including a plurality of second fingers attached to said hub, each said second finger extending generally radially outwardly from said hub, said plurality of second fingers being located in a generally circular manner about said longitudinal axis of said hub and generally uniformly spaced with respect to one another about said longitudinal axis of said hub, each said second finger including a base located at said hub, a tip spaced generally radially outwardly from said hub and a central axis extending from said base to said tip.

12. The cutting member of claim 11 wherein each said first finger and each said second finger is respectively generally formed as a truncated pyramid.

13. The cutting member of claim 11 wherein said central radial axes of said first fingers are generally located in a common first plane and said central radial axes of said second fingers are generally located in a common second plane that is spaced apart from said first plane.

14. The cutting member of claim 11 wherein each said second finger is located in a rotated position about said longitudinal axis of said hub with respect to a respective first finger.

15. The cutting member of claim 14 wherein each adjacent pair of first fingers are disposed at an angle relative to one another about said longitudinal axis of said hub, each said second finger being located in a rotated position about said longitudinal axis with respect to a respective pair of adjacent first fingers such that said second finger substantially bisects said angle between said adjacent pair of first fingers.

16. The cutting member of claim 11 including four first fingers disposed about said longitudinal axis of said hub at generally right angles to one another, and four second fingers disposed about said longitudinal axis of said hub at generally right angles to one another.

17. The cutting member of claim 16 wherein each said second finger is located in a position rotated approximately forty-five degrees about said longitudinal axis of said hub relative to a respective first finger.

18. A cleaning apparatus for dislodging adherent bulk material in a container, said cleaning apparatus including:

a head and a rotor rotatably attached to said head, said rotor being rotatable about a first axis;

an elongate flail having a first end and a second end, said first end of said flail attached to said rotor such that said rotor is adapted to rotate said second end of said flail about said first axis; and a cutting member associated with said flail such that said cutting member is adapted to rotate about said first axis in association with said flail, said cutting member including a hub having a first end and a second end and a second axis extending from said first end to said second end of said hub, a plurality of first fingers extending generally radially outwardly from said hub, said plurality of first fingers being located in a generally circular manner about said second axis of said hub and generally uniformly spaced with respect to one another about said hub, each said first finger having a base located toward said hub, a tip spaced generally radially outwardly from said hub and a central radial axis extending from said base to said tip;

whereby said cutting member is adapted to be urged by said flail of said cleaning apparatus into engagement with adherent bulk material in the container such that said first fingers dislodge the adherent bulk material and thereby free the bulk material to flow through the container.

19. The cleaning apparatus of claim 18 wherein each said first finger is generally pyramidal-shaped and includes a plurality of side cutting surfaces extending from said base to said tip of said first finger.

20. The cleaning apparatus of claim 18 wherein each said first finger is generally formed as a truncated pyramid having an apex surface at said tip of said first finger.

21. The cleaning apparatus of claim 18 wherein said central radial axes of said first fingers are generally located in a common plane that is generally perpendicular to said second axis of said hub.

22. The cleaning apparatus of claim 18 including a plurality of second fingers attached to said hub, each said second finger extending generally radially outwardly from said hub, said plurality of second fingers being located in a generally circular manner about said second axis of said hub and generally uniformly spaced with respect to one another about said second axis of said hub, each said second finger including a base located at said hub, a tip spaced generally radially outwardly from said hub and a central axis extending from said base to said tip.

23. The cleaning apparatus of claim 22 wherein said central radial axes of said first fingers are generally located in a common first plane and said central radial axes of said second fingers are generally located in a common second plane that is spaced apart from and generally parallel to said first plane.

24. The cleaning apparatus of claim 22 wherein each said second finger is located in a rotated position about said longitudinal axis of said hub with respect to a respective first finger.

25. The cleaning apparatus of claim 18 wherein said cutting member is rotatable about said second axis of said hub with respect to said flail.

26. The cleaning apparatus of claim 18 wherein said cutting member is movable linearly along said flail.

* * * * *